US010519711B2

(12) United States Patent
Alvarez

(10) Patent No.: US 10,519,711 B2
(45) Date of Patent: Dec. 31, 2019

(54) GARAGE DOOR WINDOW ASSEMBLY

(71) Applicant: Cuauhtemoc V. Alvarez, Tucson, AZ (US)

(72) Inventor: Cuauhtemoc V. Alvarez, Tucson, AZ (US)

( * ) Notice: Subject to any disclaimer, the term of this patent is extended or adjusted under 35 U.S.C. 154(b) by 0 days.

(21) Appl. No.: 15/366,215

(22) Filed: Dec. 1, 2016

(65) Prior Publication Data

US 2018/0142514 A1 May 24, 2018

Related U.S. Application Data

(60) Provisional application No. 62/261,819, filed on Dec. 1, 2015.

(51) Int. Cl.

| | |
|---|---|
| ***E06B 3/70*** | (2006.01) |
| ***E06B 3/964*** | (2006.01) |
| ***E06B 3/54*** | (2006.01) |
| ***E06B 3/72*** | (2006.01) |
| ***E06B 3/28*** | (2006.01) |
| ***E06B 3/58*** | (2006.01) |
| ***E06B 3/26*** | (2006.01) |
| *E06B 3/30* | (2006.01) |

(52) U.S. Cl.

CPC ..... *E06B 3/7001* (2013.01); *E06B 3/2605* (2013.01); *E06B 3/28* (2013.01); *E06B 3/5454* (2013.01); *E06B 3/5892* (2013.01); *E06B 3/72* (2013.01); *E06B 3/9644* (2013.01); *E06B 3/30* (2013.01); *E06B 2003/7011* (2013.01); *E06B 2003/7044* (2013.01); *E06B 2003/7059* (2013.01)

(58) Field of Classification Search

CPC ..... E06B 3/7001; E06B 3/5892; E06B 3/28; E06B 3/72; E06B 3/5454; E06B 3/9644; E06B 2003/7044; E06B 2003/7011; E06B 2003/7059; E06B 3/30; E06B 3/5878; E06B 3/26; E06B 3/2605; E06B 2003/262

See application file for complete search history.

(56) References Cited

U.S. PATENT DOCUMENTS

| | | | | |
|---|---|---|---|---|
| 3,750,358 A * | 8/1973 | Lewkowitz | E06B 3/5857 | 52/204.597 |
| 5,018,330 A * | 5/1991 | Lewkowitz | E06B 3/5892 | 52/455 |
| 5,570,548 A * | 11/1996 | Hopper | E06B 3/22 | 52/204.5 |
| 8,359,796 B1 * | 1/2013 | Plummer | E06B 3/5892 | 52/204.61 |
| 8,365,480 B1 * | 2/2013 | Plummer | E06B 3/5892 | 52/204.62 |
| 8,434,284 B1 * | 5/2013 | Plummer | E06B 3/5892 | 52/745.16 |
| 2003/0115811 A1 * | 6/2003 | Sibbett | E06B 3/5892 | 52/204.7 |

FOREIGN PATENT DOCUMENTS

GB 504905 A * 5/1939 ..... B44F 1/066

* cited by examiner

*Primary Examiner* — Jessie T Fonseca

(57) ABSTRACT

A method to form a garage door window assembly, the method including providing (N) first trim members and (N) second trim members, wherein (N) is 3 or greater, releaseably attaching an (i)th first trim member to an (i)th second trim member to form an (i)th trim assembly, where (i) is 1 to (N). Releaseably affixing a (j)th trim assembly to a (j+1)th trim assembly, where (j) is 1 to (N−1).

2 Claims, 7 Drawing Sheets

GARAGE DOOR WINDOW ASSEMBLY

CROSS-REFERENCE TO RELATED APPLICATIONS

This Application claims priority from a United States Provisional Application filed Dec. 1, 2015 and having Ser. No. 62/261,819.

FIELD OF THE INVENTION

This disclosure relates to a garage door window assembly and a method to form same.

BACKGROUND OF THE INVENTION

Recently, there is an increasing demand for garage door owners to decorate their windows with designs. Yet, the currently available garage door window assemblies are complex and prevent the owner from changing an ornamental look. Prior art garage door windows are generally fixed to the garage door and made of multiple parts that require fasteners and are therefore permanent, thereby forcing the owner to keep the installed design. Those that do not use fasteners, instead use a two-part locking device that seals the pieces permanently. For both assemblies that require fasteners and those that use a two-part locking system, the owner is forced to hire a professional change the design or replace the window due to the complexity of the assembly.

The prior art window assemblies use materials, such as thin plastic, that do not allow disassembling and will not withstand extreme weather conditions. It is likely that the window will break and often times the entire window assembly must be replaced. Changing designs is impractical and costly.

SUMMARY OF THE INVENTION

A garage door window assembly is disclosed. As shown in FIG. 5, Applicant's garage window assembly comprises a first frame 510, a second frame 520, and an insert 600 disposed between the first frame 510 and the second frame 520.

A method to form a window assembly is disclosed. The method includes providing three or more first trim members, and three or more second trim members. The method further includes releaseably attaching each first trim member to a second trim member to form an a trim assembly. An ornamental insert is removeably disposed between a first frame comprising the three or more first trim members and a second frame comprising the three or more second trim members.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Disclosed is a garage window assembly and a method to form same.

Figure 5:
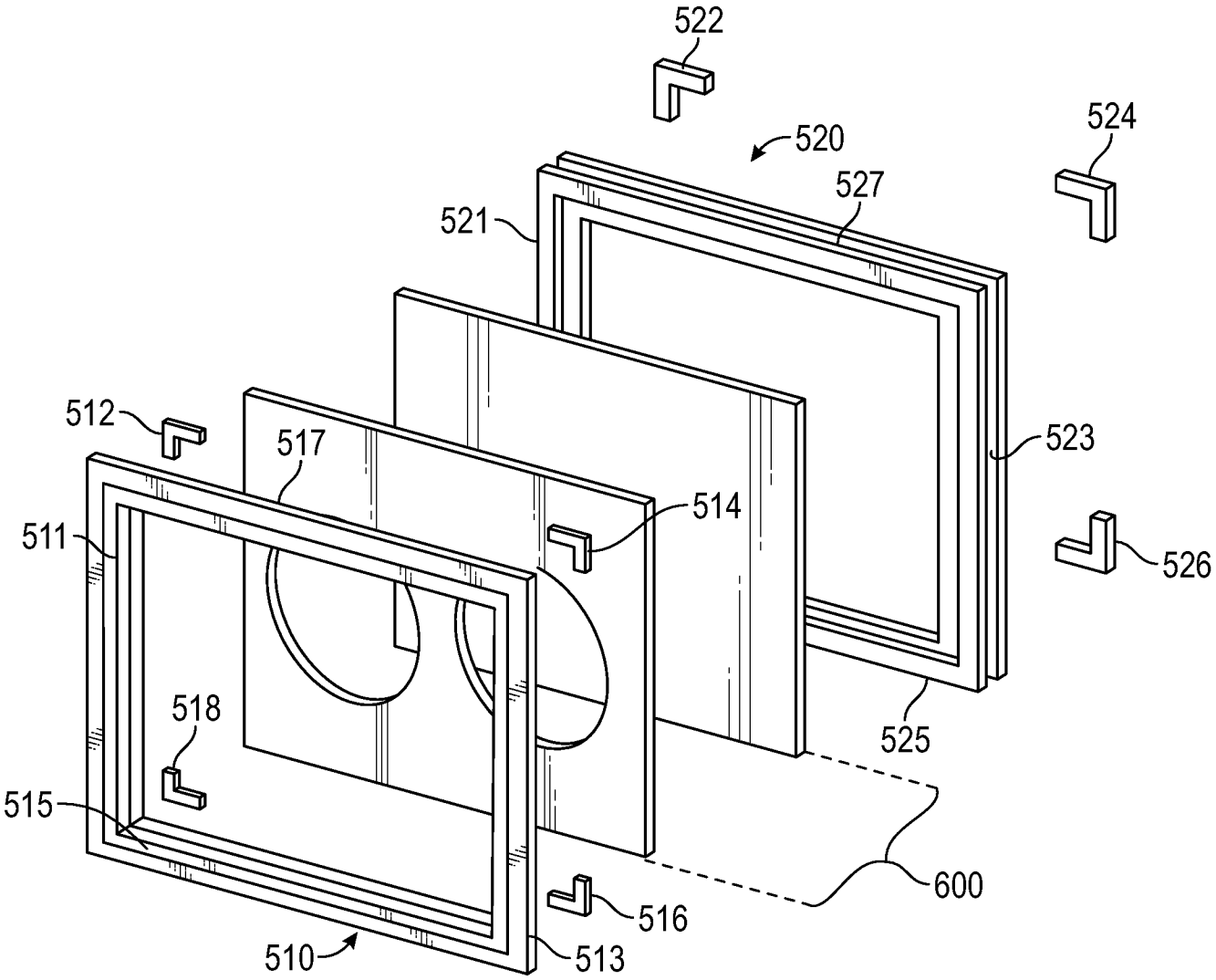
FIG. 5 illustrates the components of Applicant's garage door window assembly.

Referring now to FIG. 5, Applicant's garage window assembly comprises a first frame 510, a second frame 520 and an insert 600 disposed between the first frame 510 and the second frame 520.

First frame 510 comprises trim members 511, 513, 515, 517. Trim member 511 is attached to trim member 14 using fixturing member 512. Trim member 511 is attached to trim member 515 using fixturing member 518. Trim member 517 is attached to trim member 513 using fixturing member 514. Trim member 515 is attached to trim member 513 using fixturing member 516.

Second frame 520 comprises trim members 521, 523, 525 and 527. Trim member 521 is attached to trim member 527 using fixturing member 522. Trim member 521 is attached to trim member 525 using fixturing member 528. Trim member 527 is attached to trim member 523 using fixturing member 524. Trim member 525 is attached to trim member 523 using fixturing member 526.

Figure 1:
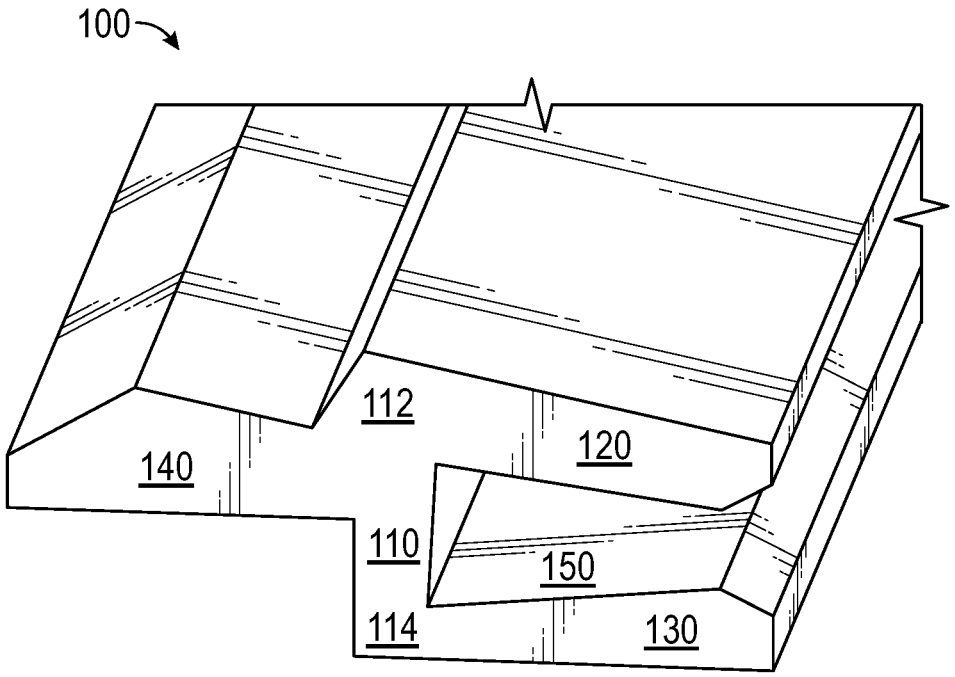
FIG. 1 illustrates a first trim member 100.

Referring now to FIG. 1, each first trim member 100 comprises a first member 110, a second member 120 extending outwardly in a first direction from a first end of the first member, a third member 130 extending outwardly in the first direction from a second end of said first member, a fourth member 140 extending outwardly in a second and opposite direction from said first member 110, wherein the second member 120 and the third member 130 define a first U-shaped space 150.

Figure 2:
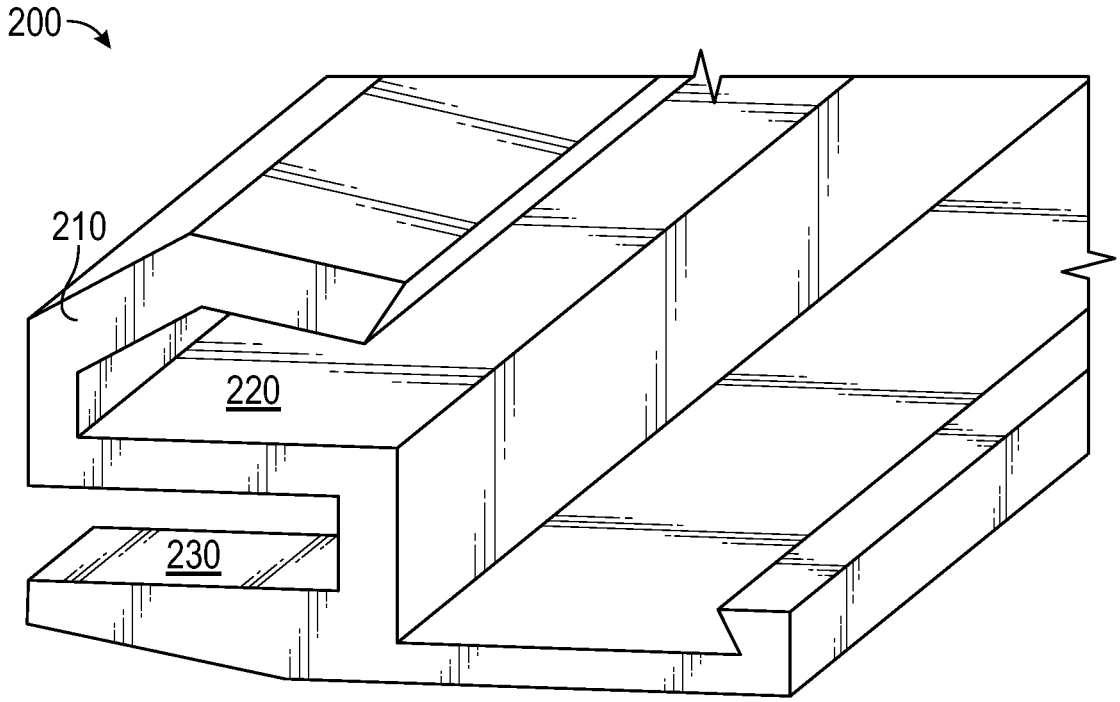
FIG. 2 illustrates a second trim member 200.
Figure 3:
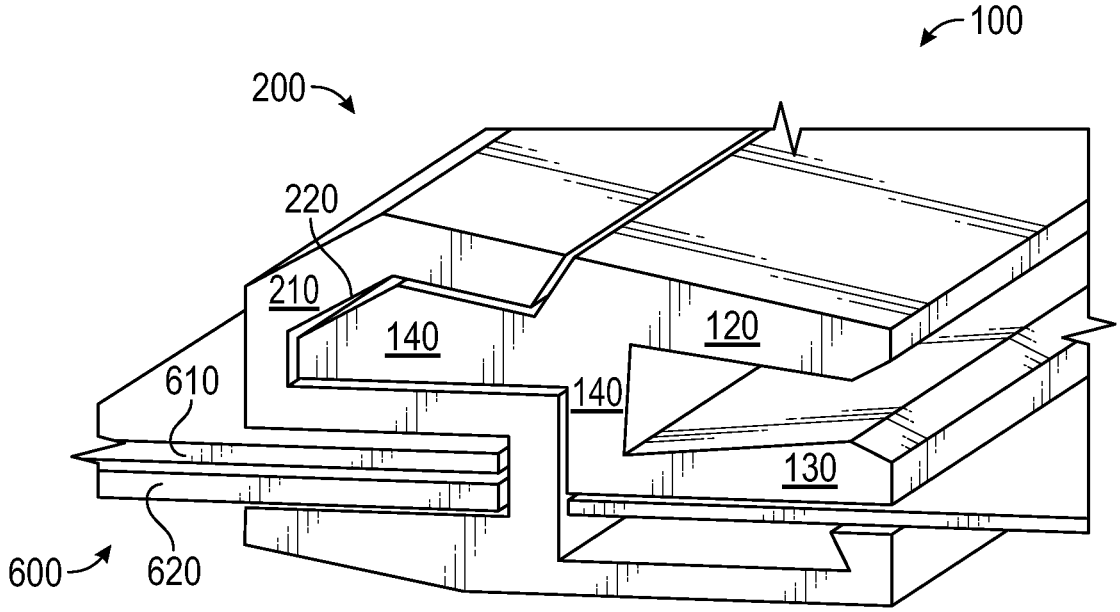
FIG. 3 illustrates a trim assembly 300 comprising a first trim member 100 releaseably attached to a second trim member 200.

Referring now to FIG. 2, each second trim member 200 comprises a S-shaped member 210 defining a second U-shaped space 220 and a third U-shaped space 230. FIG. 3 illustrates first trim member 100 releaseably attached to second trim member 200 to form a trim assembly 300. Member 140 of trim member 100 is shown removably inserted into second U-shaped space 220 and insert 600 is removably inserted into the third U-shaped space 230.

Referring now to FIG. 5, Applicant's garage door window assembly comprises a first frame 510, a second frame 520, and an insert 600 removably disposed between the first frame 510 and the second frame 520. Insert 600 comprises a visually transparent planar member 620 (FIG. 3) and a planar design member 610 (FIG. 3). In certain embodiments the visually transparent member 620 is adhesively bonded to the planar design member 610.

First frame 510 comprises first trim members 511, 513, 515, and 517. Trim member 511 is releaseably attached to trim member 517 by inserting a first leg of triangular fixturing bracket 512 into U-shaped space 150 of trim member 511, and a second leg of triangular fixturing bracket 512 into U-shaped space 150 of trim member 517. Trim member 511 is releaseably attached to trim member 515 by inserting a first leg of triangular fixturing bracket 518 into U-shaped space 150 of trim member 511, and a second leg of triangular fixturing bracket 518 into U-shaped space 150 of trim member 515. Trim member 515 is releaseably attached to trim member 513 by inserting a first leg of triangular fixturing bracket 516 into U-shaped space 150 of trim member 515, and a second leg of triangular fixturing bracket 516 into U-shaped space 150 of trim member 513. Trim member 513 is releaseably attached to trim member 517 by inserting a first leg of triangular fixturing bracket 516 into U-shaped space 150 of trim member 513, and a second leg of triangular fixturing bracket 516 into U-shaped space 150 of trim member 517.

Second frame 520 comprises second trim members 521, 523, 525, and 527. Trim member 521 is releaseably attached to trim member 527 by inserting a first leg of triangular fixturing bracket 522 into U-shaped space 150 of trim member 521, and a second leg of triangular fixturing bracket 522 into U-shaped space 150 of trim member 527. Trim member 521 is releaseably attached to trim member 525 by inserting a first leg of triangular fixturing bracket 528 (not shown in FIG. 5) into U-shaped space 150 of trim member 521, and a second leg of triangular fixturing bracket 528 (not shown in FIG. 5) into U-shaped space 150 of trim member 525. Trim member 525 is releaseably attached to trim member 523 by inserting a first leg of triangular fixturing bracket 526 into U-shaped space 150 of trim member 525, and a second leg of triangular fixturing bracket 526 into U-shaped space 150 of trim member 523. Trim member 523 is releaseably attached to trim member 527 by inserting a first leg of triangular fixturing bracket 524 into U-shaped space 150 of trim member 523, and a second leg of triangular fixturing bracket 524 into U-shaped space 150 of trim member 527.

Insert 600 is releaseably inserted into U-Shaped space 230 of each trim member 512, 523, 525, and 527. By disassembling first frame 510 (FIG. 5), and by disassembly second frame 520 (FIG. 5), design insert 610 can be changed to reflect a different ornamental design.

Figure 6:
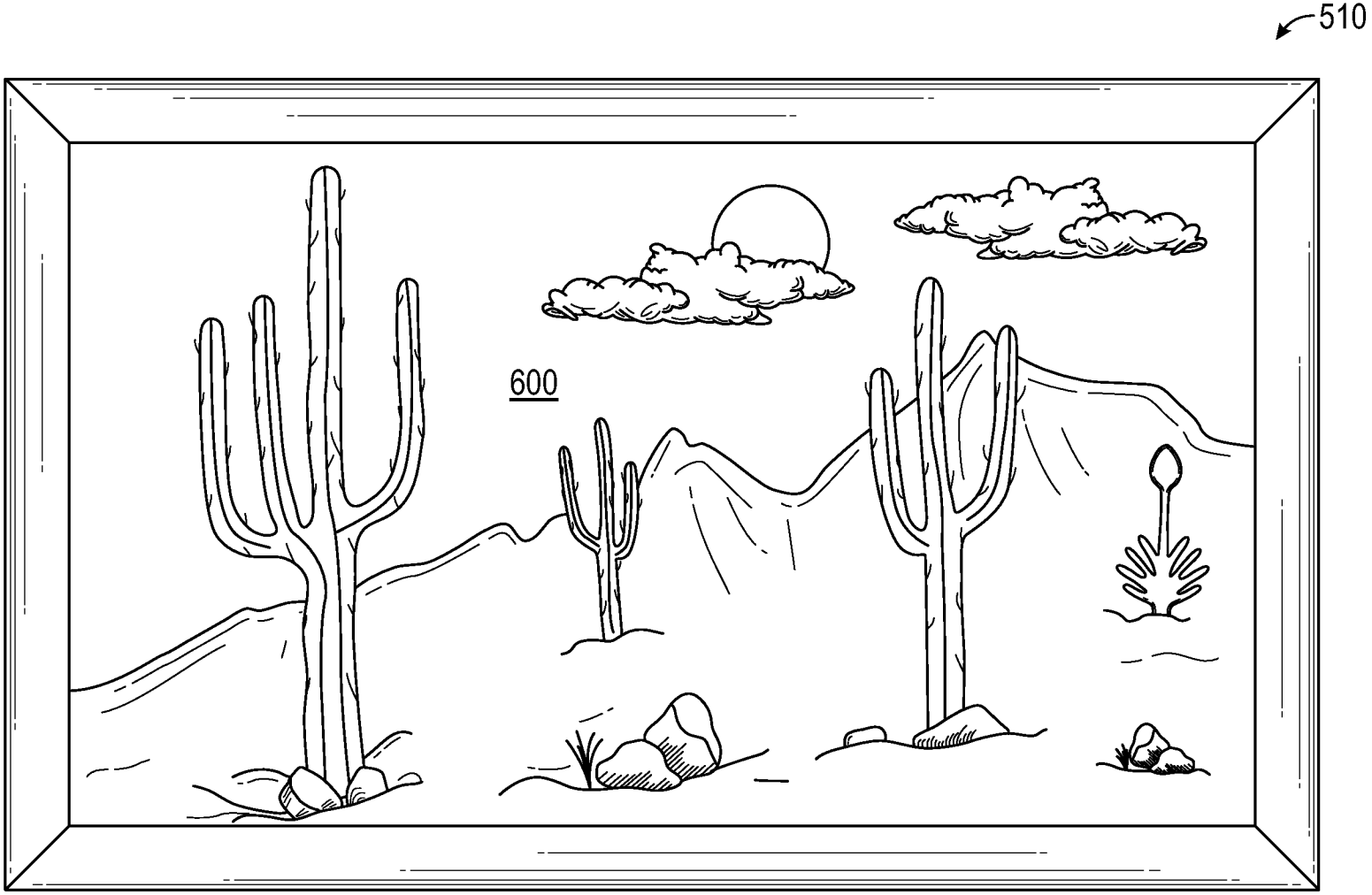
FIG. 6 illustrates insert 600 formed to include an ornamental design extending therethrough.

FIG. 6 is a top view of assembly 500. FIG. 6 shows first frame 510 and removable design insert 610 comprising a desert scene extending through a visually opaque rectangular member. A sheet of visually transparent material 620 is disposed over top of design insert 610. In certain embodiments, the visually transparent material comprises glass, polystyrene, polycarbonate, and the like.

Figure 7:
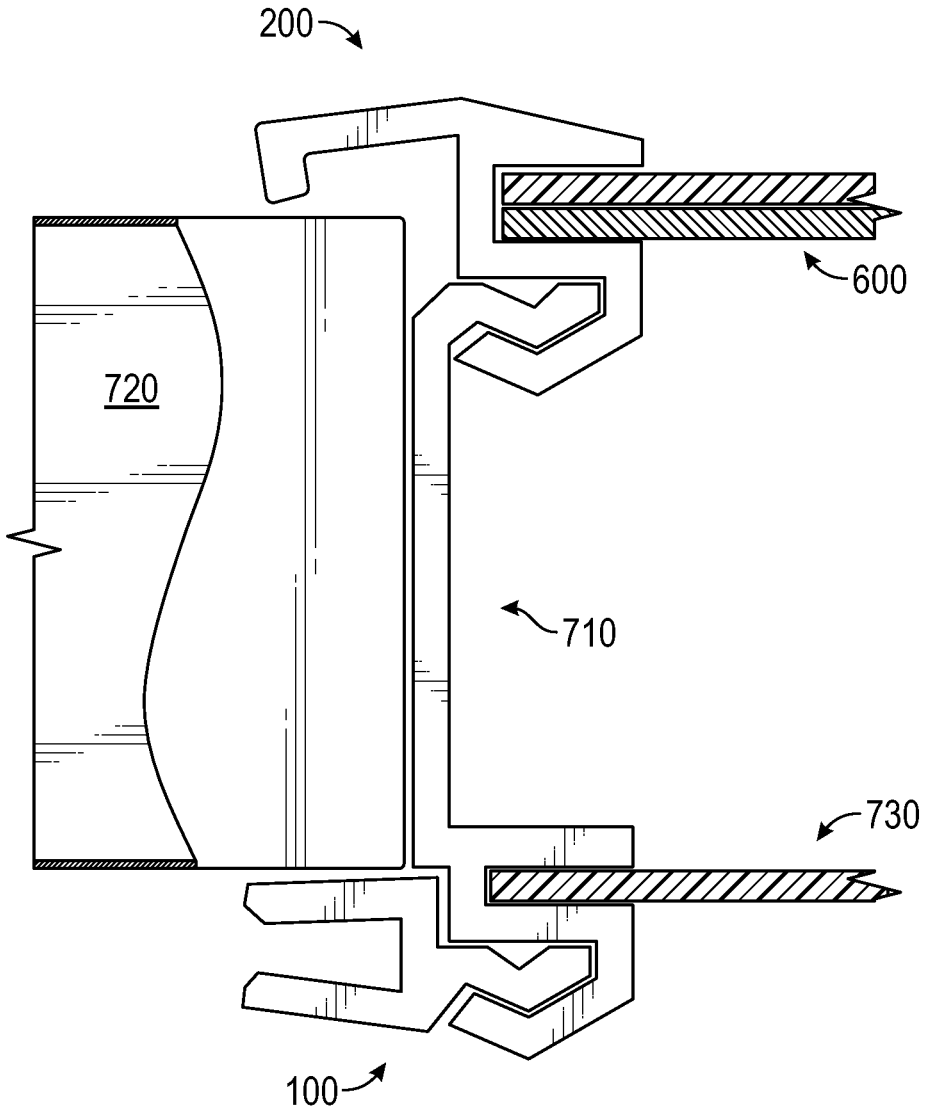
FIG. 7 illustrates a third trim member usable with wide garage doors.

FIG. 7 illustrates Applicant's garage door window assembly for thicker garage doors. Extension member 710 interconnects first trim member 100 and second trim member 200. Extension member 710 is molded to comprise a length necessary for a specific width garage door. The extension member releasably interconnects with said first trim member 100 and said second trim member 200 at said second U-shaped space 220 and said fourth member 240 to form an extended releasable trim assembly.

Figure 4:
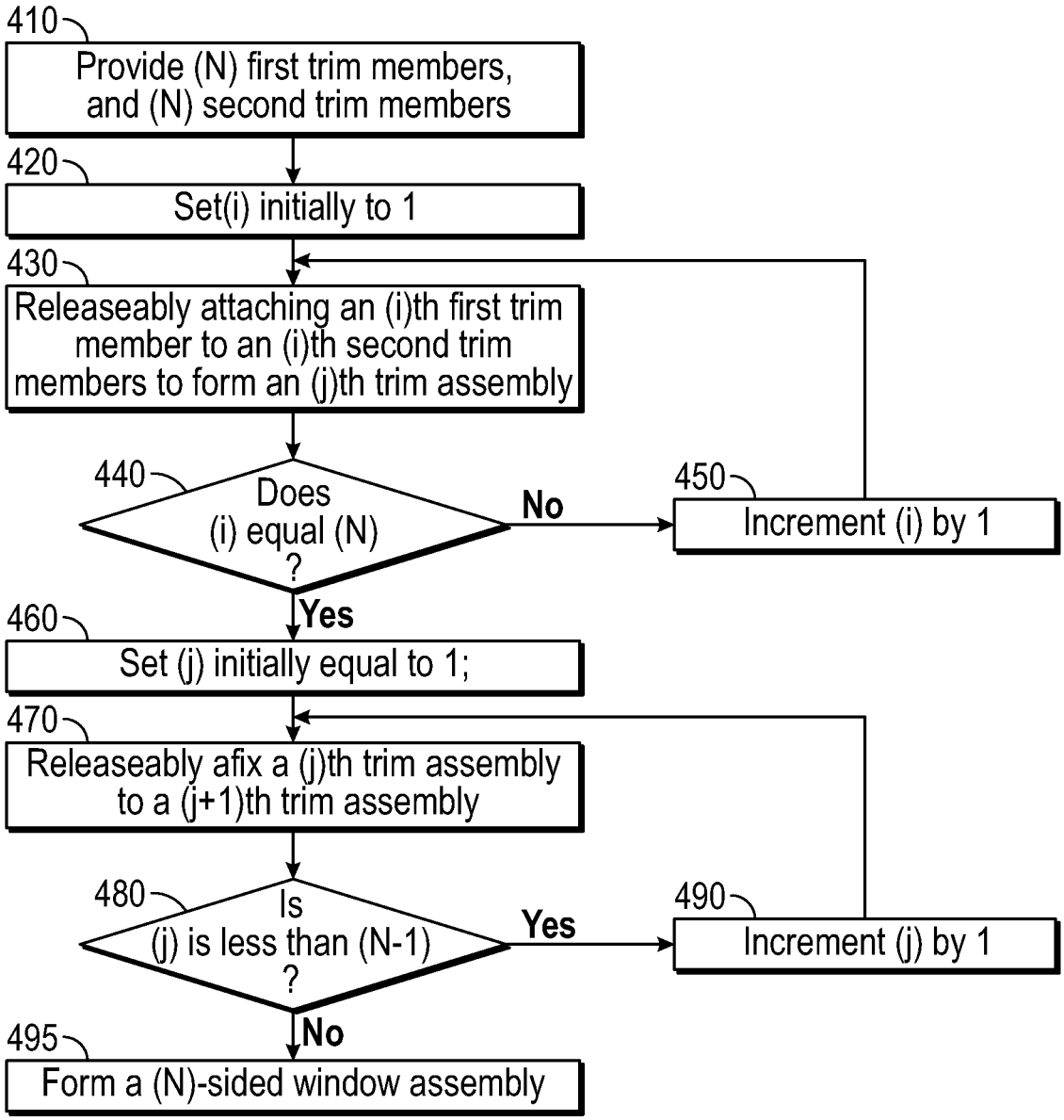
FIG. 4 is a flow chart summarizing Applicant's method to form his garage door window assembly.

FIG. 4 summarizes Applicant's method to form his garage window assembly. Referring to FIG. 4, in step 410 the method provides (N) first trim members. Referring now to FIG. 1, first trim member 100 comprises a first member 110, a second member 120 extending outwardly in a first direction from a first end 112 of first member 110, a third member 130 extending outwardly in the first direction from a second end 114 of first member 110, a fourth member 140 extending outwardly in a second and opposite direction from first member 110, wherein second member 120 and third member 130 define a first U-shaped space 150.

Referring once again to FIG. 4, in step 410 the method further provides (N) second trim members. Referring now to FIG. 2, second trim member 200 comprises a S-shaped member 210 defining a second U-shaped space 220 and a third U-shaped space 230.

Referring once again to FIG. 4, in step 430 the method releaseably attaches a first trim member 100 to a second trim member 200 to form a trim assembly 300. Referring now to FIG. 3, in trim assembly 300 third member 140 of trim member 100 is shown removeably inserted into U-shaped space 220 of second trim member 200.

Applicant's method can form a garage door window comprising (N) sides, wherein (N) is greater than or equal to 3. In embodiments wherein the formed windows assembly comprises three sides, i.e. a triangular window, the method forms three trim assemblies 300 as described hereinabove. A first end of a first trim assembly is releaseably attached to a first end of a second trim assembly to form a first subcombination having a first end and a second end. Thereafter, the first end of the first subcombination is releaseably attached to a first end of a third trim assembly. The second end of that third trim assembly is then releaseably attached to a second end of the first subcombination to form the three-sided window assembly.

A four sided window assembly is similarly formed from four trim assemblies. FIG. 5 illustrates a first subcombination comprising four first trim members 100 releaseably attached to one another to form a four-sided first frame. FIG. 5 further illustrates a second subcombination comprises four second trim member 200 attached to one another to form a four-sided second from. FIG. 5 further illustrates a visually transparent member 620 and a design template 610 disposed between the first frame and the second frame.

A five-sided window assembly is formed from five trim assemblies. In general, a (N)-sided window assembly is formed from (N) trim assemblies 300.

While the preferred embodiments of the present invention have been illustrated in detail, it should be apparent that modifications and adaptations to those embodiments may occur to one skilled in the art without departing from the scope of the present invention.

I claim:

1. A garage door comprising a releasable trim assembly, said trim assembly comprising:

a first trim member comprising of a first member having a first end and second end, a second member extending from said first end in a first direction, a third member connected to said second end of said first member extending in said first direction, and a fourth member extending from said first member in a second direction opposite said first direction, wherein said first member, said second member and said third member define a first U-shaped space;

a second trim member comprising of a S-shaped member adjacent to a fifth member extending in said first direction from an end of said S-shaped member, wherein a lip extends from an end of said fifth member, wherein a channel is defined by a vertical portion of said S-shaped member, said fifth member and said lip, wherein said S-shaped member comprises a second U-shaped space and a third U-shaped space; and said first trim member and said second trim member releasably attach to form said releasable trim assembly by removably inserting said fourth member into said second U-shaped space.

2. The garage door comprising a releasable trim assembly of claim 1, said trim assembly further comprising an extension member;

the extension member comprising:

a second S-shaped member coupled to a sixth member;

wherein a second lip extends from said sixth member, wherein said second S-shaped member, said sixth member and said second lip form a second channel;

said extension member configured to releasably interconnect with said first trim member and said second trim member at said second U-shaped space and said fourth member to form an extended releasable trim assembly.

* * * * *